US009465395B2

(12) United States Patent
Fan

(10) Patent No.: US 9,465,395 B2
(45) Date of Patent: Oct. 11, 2016

(54) VOLTAGE GENERATING CIRCUIT

(71) Applicant: M31 Technology Corporation, Hsinchu County (TW)

(72) Inventor: Hung-Cheng Fan, Taoyuan (TW)

(73) Assignee: M31 Technology Corporation, Hsinchu County (TW)

( * ) Notice: Subject to any disclaimer, the term of this patent is extended or adjusted under 35 U.S.C. 154(b) by 83 days.

(21) Appl. No.: 14/662,255

(22) Filed: Mar. 19, 2015

(65) Prior Publication Data

US 2016/0098049 A1 Apr. 7, 2016

(30) Foreign Application Priority Data

Oct. 3, 2014 (TW) ..... 103134588 A

(51) Int. Cl.
*G05F 1/10* (2006.01)
*G05F 3/02* (2006.01)
*G05F 1/56* (2006.01)

(52) U.S. Cl.
CPC ..... *G05F 1/56* (2013.01)

(58) Field of Classification Search
USPC ..... 327/536, 540
See application file for complete search history.

(56) References Cited

U.S. PATENT DOCUMENTS 4,728,828 A * 3/1988 Goodnough ..... H03F 3/08 327/434
6,515,612 B1 * 2/2003 Abel ..... G11C 27/026 327/382
6,590,372 B1 * 7/2003 Wiles, Jr. ..... G05F 3/30 323/316
9,276,464 B2 * 3/2016 Chu ..... H02M 3/07
9,385,596 B1 * 7/2016 Yang ..... H02M 3/07
2001/0001230 A1 * 5/2001 Proebsting ..... G05F 3/205 327/536
2002/0011894 A1 1/2002 Keeth et al.
2002/0167350 A1 11/2002 Sato et al.
2002/0196072 A1 12/2002 Rosa
2003/0085752 A1 * 5/2003 Rader ..... H02M 3/07 327/536
2003/0141922 A1 7/2003 Keeth et al.

(Continued)

FOREIGN PATENT DOCUMENTS

TW 494631 7/2002
TW 200428757 A 12/2004

(Continued)

OTHER PUBLICATIONS

Chris Schell, Voltage Doubler Design and Analysis, Texas Instruments, TI technical document, SNAA095, National Semiconductor, AN-1119, Jun. 2001.

*Primary Examiner* — Adam Houston
(74) *Attorney, Agent, or Firm* — Winston Hsu; Scott Margo

(57) ABSTRACT

A voltage generating circuit includes: (1) a driving unit having an input terminal and an output terminal, wherein the input terminal is configured to receive an input signal, wherein when the input signal is at a first logic level, power is configured to be charged from a first voltage terminal to the output terminal, and when the input signal is at a second logic level, power is configured to be discharged from the output terminal to a second voltage terminal; (2) a first switch configured to couple the second voltage terminal to a capacitance-compensating terminal based on the input signal; (3) a compensating capacitor configured to be coupled between the capacitance-compensating terminal and a third voltage terminal; and (4) a second switch configured to couple the capacitance-compensating terminal to a fourth voltage terminal based on the input signal.

13 Claims, 7 Drawing Sheets

(56) References Cited

U.S. PATENT DOCUMENTS

| | | | | |
|---|---|---|---|---|
| 2004/0263238 | A1 | 12/2004 | Thorp et al. | |
| 2005/0225380 | A1 | 10/2005 | Ingino | |
| 2006/0017496 | A1 | 1/2006 | Yamada et al. | |
| 2006/0186947 | A1 | 8/2006 | Lin et al. | |
| 2006/0290412 | A1 | 12/2006 | Jung et al. | |
| 2007/0176670 | A1 | 8/2007 | Corsonello et al. | |
| 2008/0157853 | A1 | 7/2008 | Al-Shamma et al. | |
| 2008/0157854 | A1 | 7/2008 | Al-Shamma et al. | |
| 2009/0115498 | A1 | 5/2009 | Al-Shamma et al. | |
| 2009/0140903 | A1* | 6/2009 | Edwards | H03M 1/002 341/150 |
| 2010/0045368 | A1 | 2/2010 | Ito et al. | |
| 2012/0013396 | A1 | 1/2012 | Morino et al. | |
| 2013/0063118 | A1 | 3/2013 | Nguyen | |
| 2013/0177175 | A1 | 7/2013 | Ting | |
| 2014/0354376 | A1* | 12/2014 | Madadi | H03H 15/00 333/166 |
| 2016/0098049 | A1* | 4/2016 | Fan | G05F 1/56 323/280 |
| 2016/0218854 | A1* | 7/2016 | Chong | H04L 7/0012 |

FOREIGN PATENT DOCUMENTS

| | | | |
|---|---|---|---|
| TW | 201042894 | A1 | 12/2010 |
| WO | 2005022752 | A1 | 3/2005 |

* cited by examiner

VOLTAGE GENERATING CIRCUIT

RELATED APPLICATION

This application claims priority to TW application No. 103134588, filed on Oct. 3, 2014, all of which is incorporated herein by reference in their entirety.

BACKGROUND OF THE DISCLOSURE

1. Field of the Disclosure

The disclosure relates to a voltage generating circuit, and more particularly, to a voltage generating circuit configured to be compensated by a capacitor.

2. Brief Description of the Related Art

An integrated circuit may employ a low-dropout (LDO) regulator or a pulse-width modulation (PWM) circuit to generate an adequate voltage. However, the employment would cause increase of circuit costs and the low-dropout (LDO) regulator and pulse-width modulation (PWM) circuit may have the integrated circuit to operate at a limited speed and with a stability issue. For example, when a circuit is utilized to process a serial data stream at a high speed, such as at a speed higher than 1 GHz, the LDO regulator and the PWM circuit may not meet the requirement.

SUMMARY OF THE DISCLOSURE

Accordingly, the present invention provides a switching-capacitor type of voltage generating circuit to address the above problem.

In accordance with an embodiment of the present invention, a voltage generating circuit includes: (1) a first driving unit having a first input terminal and a first output terminal, wherein the first input terminal is configured to receive a first input signal, wherein when the first input signal is at a first logic level, power is configured to be charged from a first voltage terminal to the first output terminal, and when the first input signal is at a second logic level, power is configured to be discharged from the first output terminal to a second voltage terminal; (2) a first switch configured to couple the second voltage terminal to a first capacitance-compensating terminal based on the first input signal; (3) a first compensating capacitor configured to be coupled between the first capacitance-compensating terminal and a third voltage terminal; and (4) a second switch configured to couple the first capacitance-compensating terminal to a fourth voltage terminal based on the first input signal.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
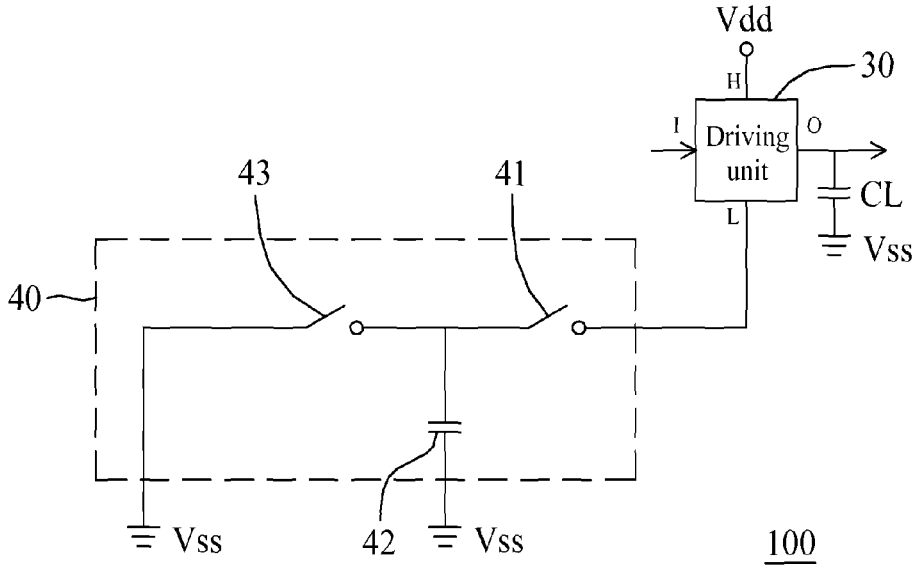
FIG. 1 shows a circuit diagram of a voltage generating circuit in accordance with an embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

FIG. 1 shows a circuit diagram of a voltage generating circuit in accordance with an embodiment of the present invention. Referring to FIG. 1, a voltage generating circuit 100 includes a first driving unit 30, a first switch 41, a first compensating capacitor 42 and a second switch 43. The first driving unit 30 has a first input terminal I and a first output terminal O, wherein the first input terminal I is configured to receive a first input signal. When the first input signal is at a first logic level, such as logic level of 0, power is configured to be charged from a first voltage terminal H, such as Vdd terminal, to the first output terminal O. When the first input signal is at a second logic level, such as logic level of 1, power is configured to be discharged from the first output terminal O to a second voltage terminal L. The first driving unit 30 may include an inverter, buffer or pre-stage driver. The first switch 41 is configured to be switched to couple the second voltage terminal L to a first capacitance-compensating terminal based on the first input signal. The first compensating capacitor 42 is configured to be coupled between the first capacitance-compensating terminal and a third voltage terminal, such as Vss terminal or ground. The second switch 43 is configured to couple the first capacitance-compensating terminal to a fourth voltage terminal, such as Vss terminal, based on the first input signal. Alternatively, the third voltage terminal may be a Vdd terminal, to which the present invention is not limited.

The paragraph takes an example of an inverter as the first driving unit 30 and negative metal-oxide-silicon (NMOS) devices as the first and second switches 41 and 43. When the first input signal is at a logic level of 0, power is charged from the first voltage terminal H to the first output terminal O to output a voltage level of Vdd or a logic level of 1, the first switch 41 is switched off not to couple the second voltage terminal L to the first capacitance-compensating terminal, and the second switch 43 is switched on to couple the first capacitance-compensating terminal to the third voltage terminal, such as ground, such that electric charges having been previously stored at the first capacitance-compensating terminal of the first compensating capacitor 42 may be discharged to the third voltage terminal. When the first input signal is at a logic level of 1, power is discharged from the first output terminal O to the second voltage terminal L, the second switch 43 is switched off and the first switch 41 is switched on such that the second voltage terminal L is coupled to the first capacitance-compensating terminal, and electric charges, having been stored at the first output terminal O when the first input signal is at a logic level of 0, may be charged to the first capacitance-compensating terminal of the first compensating capacitor 42; in other words, the electric charges, having been stored at the first output terminal O when the first input signal is at a logic level of 0, may have a second electric charge to be shared to the first capacitance-compensating terminal of the first compensating capacitor 42 so as to generate at the second voltage terminal L a second voltage as an output voltage at the first output terminal O. In this case, the output voltage may have substantially the same value as the second voltage. This scenario may be called a charge-sharing concept. If the first output terminal has a first output capacitance CL and the first voltage terminal is powered at a first voltage, such as Vdd, the second voltage may be generated based on the first voltage and a ratio of a capacitance of the first compensating capacitor 42 to the first output capacitance CL. For example, if Vdd equals 1.2 V and the first output capacitance CL equals the capacitance of the first compensating capacitor 42, the second voltage equals 0.6 V; if Vdd equals 1.2 V and the first output capacitance CL equals a fifth of the capacitance of the first compensating capacitor 42, the second voltage equals 0.2 V; Thereby, the capacitance of the first compensating capacitor 42 may be adjusted to control the second voltage of the second voltage terminal. The first output capacitance CL may be a capacitance seen from the first output terminal O, such as loading capacitance, parasitic capacitance and/or input capacitance of next-stage circuits.

Accordingly, when the first input signal is at a logic level of 0, a logic level of 1, i.e. a voltage level of Vdd, may be output at the first output terminal O. When the first input signal is at a logic level of 1, a logic level of 0 represented by the second voltage at the second voltage terminal may be output at the first output terminal O. The second voltage may be generated based on the first voltage and a ratio of a capacitance of the first compensating capacitor 42 to the first output capacitance CL. Thereafter, when the first input signal is at a logic level of 0 again, the second switch 43 may be switched on such that electric charges having been previously stored at the first capacitance-compensating terminal of the first compensating capacitor 42 may be discharged to the third voltage terminal, such as ground. The first input signal may be a serial data stream at a high speed, such as at a speed higher than 1 GHz. Provided that the first input signal has the number of data periods at the first logic level substantially equal to the number of data periods of the first input signal at the second logic level within a predetermined time interval, the first switch 41 has turning-on time substantially equal to turning-on time of the second switch 43 within the predetermined time interval and thereby the second voltage may be kept at a stable level within the predetermined time interval. For example, if the first input signal has nearly 50 data periods at the first logic level and nearly 50 data periods at the second logic level within a predetermined time interval of 100 data periods of the first input signal, Vdd equals 1.2 V and the first output capacitance CL equals a fifth of the capacitance of the first compensating capacitor 42, the second voltage may be kept at a stable voltage level of 0.2 V. The data stream having the number of data periods at the first logic level substantially equal to the number of data periods of the first input signal at the second logic level within a predetermined time interval is a direct-current balance signal, such as 8 b/10 b signal. Besides, the voltage generating circuit 100 may be illustrated in another way. The voltage generating circuit 100 powered by Vdd and Vss includes the first driving unit 30 and a compensating unit 40. The first driving unit 30 has the first input terminal I and the first output terminal O, wherein the first input terminal I is configured to receive the first input signal. When the first input signal is at a first logic level, such as logic level of 0, a first level signal, such as Vdd, is output at the first output terminal O. When the first input signal is at a second logic level, such as logic level of 1, a second level signal, such as the above-mentioned second voltage, is output at the first output terminal O. The compensating unit 40 includes the first switch 41, the first compensating capacitor 42 and the second switch 43 and generates the second voltage as the voltage level of the second level signal based on Vdd and the first input signal. The related operation may be referred to the above paragraphs and is omitted herein.

Figure 2:
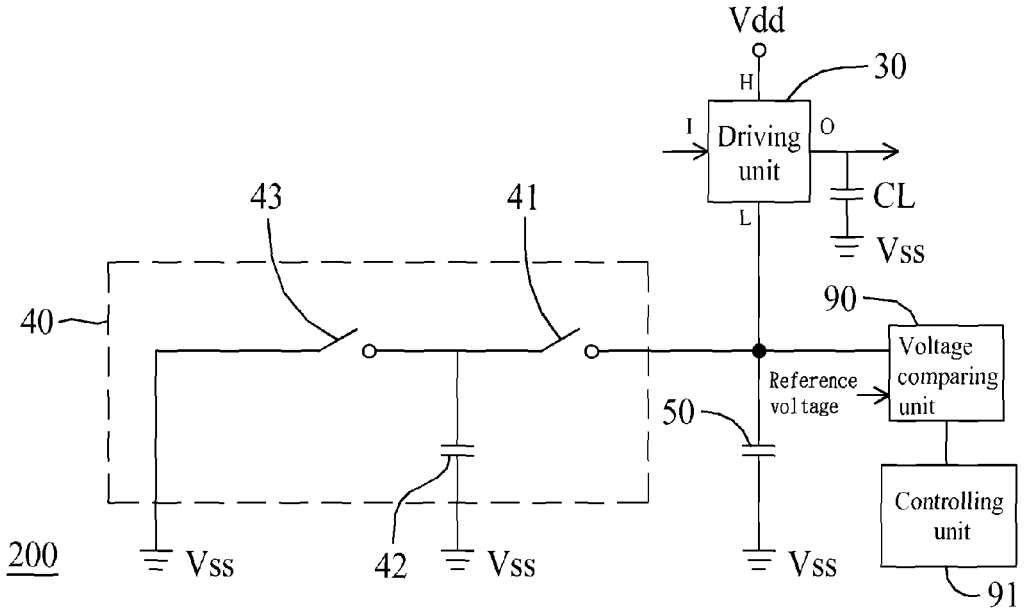
FIG. 2 shows a circuit diagram of a voltage generating circuit in accordance with another embodiment of the present invention.
Figure 3:
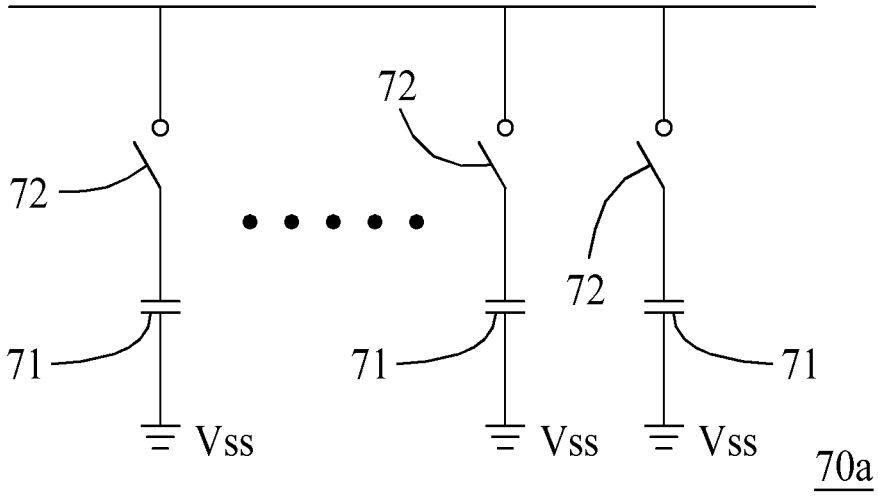
FIG. 3 shows a circuit diagram of a first adjustable compensating capacitor in accordance with an embodiment of the present invention.
Figure 4:
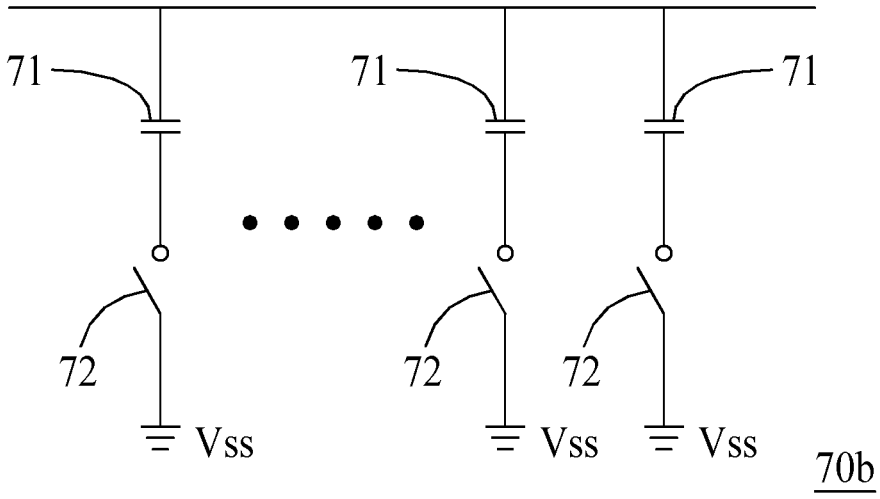
FIG. 4 shows a circuit diagram of a first adjustable compensating capacitor in accordance with another embodiment of the present invention.

FIG. 2 shows a circuit diagram of a voltage generating circuit in accordance with another embodiment of the present invention. Referring to FIG. 2, the voltage generating circuit 100 may alternatively include a voltage comparing unit 90 and a controlling unit 91. Furthermore, referring to FIGS. 3 and 4 showing switching capacitor arrays 70*a* and 70*b* for the first compensating capacitor 42, which is adjustable, in accordance with an embodiment of the present invention, the first adjustable compensating capacitor 42 may be realized by the switching capacitor arrays 70*a* and 70*b*. Each of the switching capacitor arrays 70*a* and 70*b* includes multiple capacitance-compensating units arranged in parallel, wherein each of the capacitance-compensating units includes a capacitance-compensating switch 72 and a second compensating capacitor 71 arranged in series. Each of the capacitance-compensating units may be coupled between the first capacitance-compensating terminal and the Vss terminal or between the first capacitance-compensating terminal and the Vdd terminal. The voltage comparing unit 90 is configured to compare the second voltage at the second voltage terminal L and a reference voltage so as to generate a comparison result. The controlling unit 91 is configured to control the capacitance-compensating switches 72 based on the comparison result so as to adjust the capacitance of the first compensating capacitor 42 and thus to adjust the voltage at the second voltage terminal L. For example, the voltage comparing unit 90 may compare the second voltage to the reference voltage, such as 0.2 V. If the comparing result indicates that the second voltage is greater than the reference voltage, at least one of the capacitance-compensating switches 72 may be switched on to increase the capacitance of the first compensating capacitor 42 and thus to reduce the second voltage; the above comparing step may stop until the comparing result indicates that the second voltage is less than the reference voltage. The related circuit operation may be understood by those skilled in the art and is not described herein. Alternatively, the second voltage terminal L may couple a voltage regulating capacitor 50 to stabilize the second voltage or reduce noise.

Figure 5:
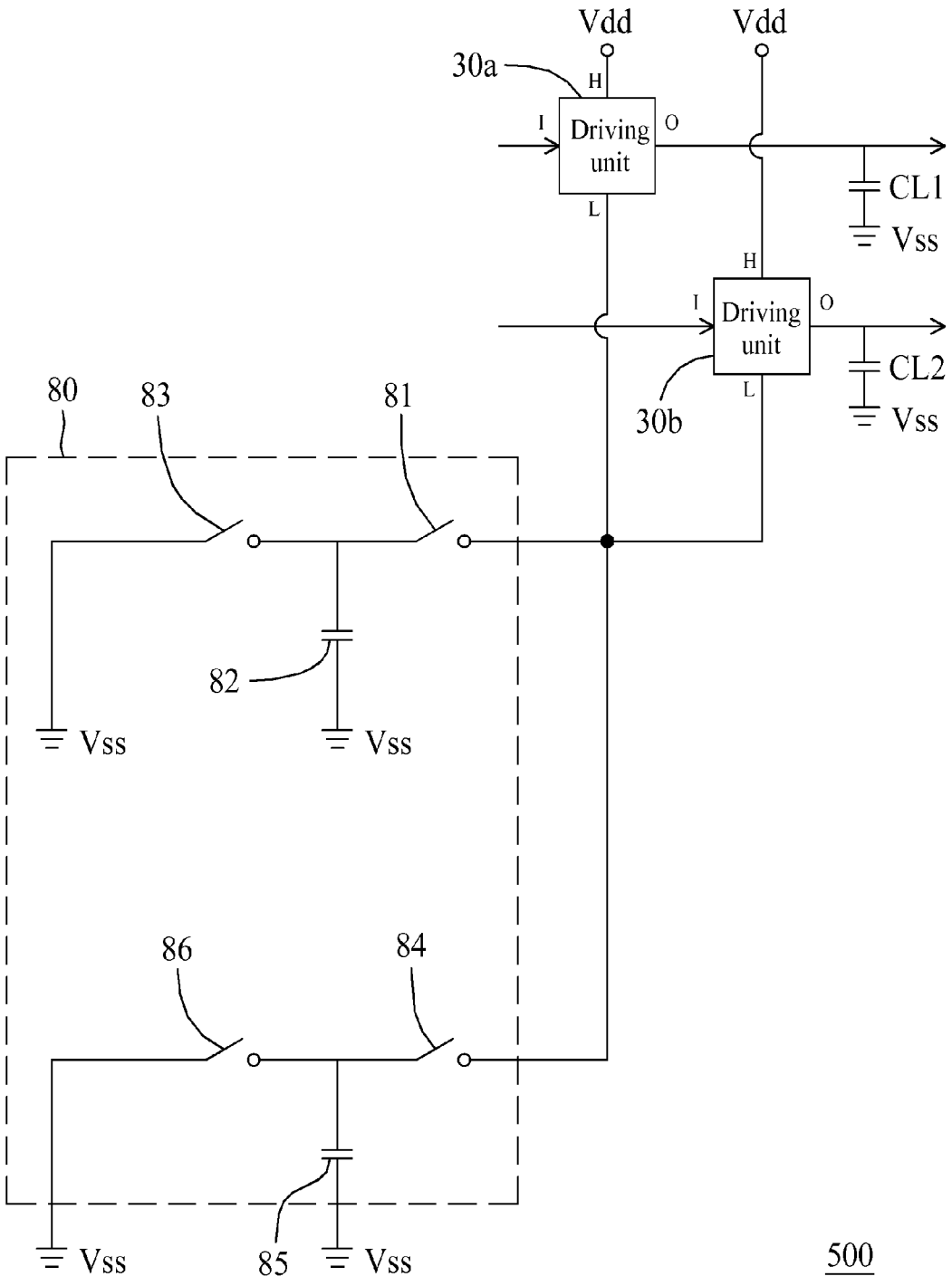
FIG. 5 shows a circuit diagram of a voltage generating circuit in accordance with another embodiment of the present invention.

FIG. 5 shows a circuit diagram of a voltage generating circuit 500, which is applied to a differential circuit, in accordance with another embodiment of the present invention. Referring to FIGS. 1 and 5, the voltage generating circuit 500 may be composed of the two sets of voltage generating circuits 100 with the second voltage terminals coupled to each other. One of the two sets of voltage generating circuits 100 has the first input signal as an input of a first driving unit 30*a;* the other one of the two sets of voltage generating circuits 100 has an inverse of the first input signal as an input of a second driving unit 30*b;* that is, the voltage generating circuit 500 receives a pair of differential signals. A first switch 81 and third switch 84 correspond to the first switch 41; a first compensating capacitor 82 and second compensating capacitor 85 correspond to the first compensating capacitor 42; a second switch 83 and fourth switch 86 correspond to the second switch 43; a first output capacitance CL1 and second output capacitance CL2 corresponds to the first output capacitance CL; compensating units 80 correspond to the two sets of compensating units 40. The operation of the voltage generating circuit 500 may be referred to the operation of the voltage generating circuit 100 as above mentioned. The similar description is omitted. It is noted that the first and third switches 81 and 83 are not switched on at the same time and the second and fourth switches 83 and 86 are not switched on at the same time. The second voltage at the second voltage terminals L may be generated based on the first voltage Vdd, a ratio of a capacitance of the first compensating capacitor 82 to the first output capacitance CL1 and a ratio of a capacitance of the second compensating capacitor 85 to the second output capacitance CL2.

Figure 6:
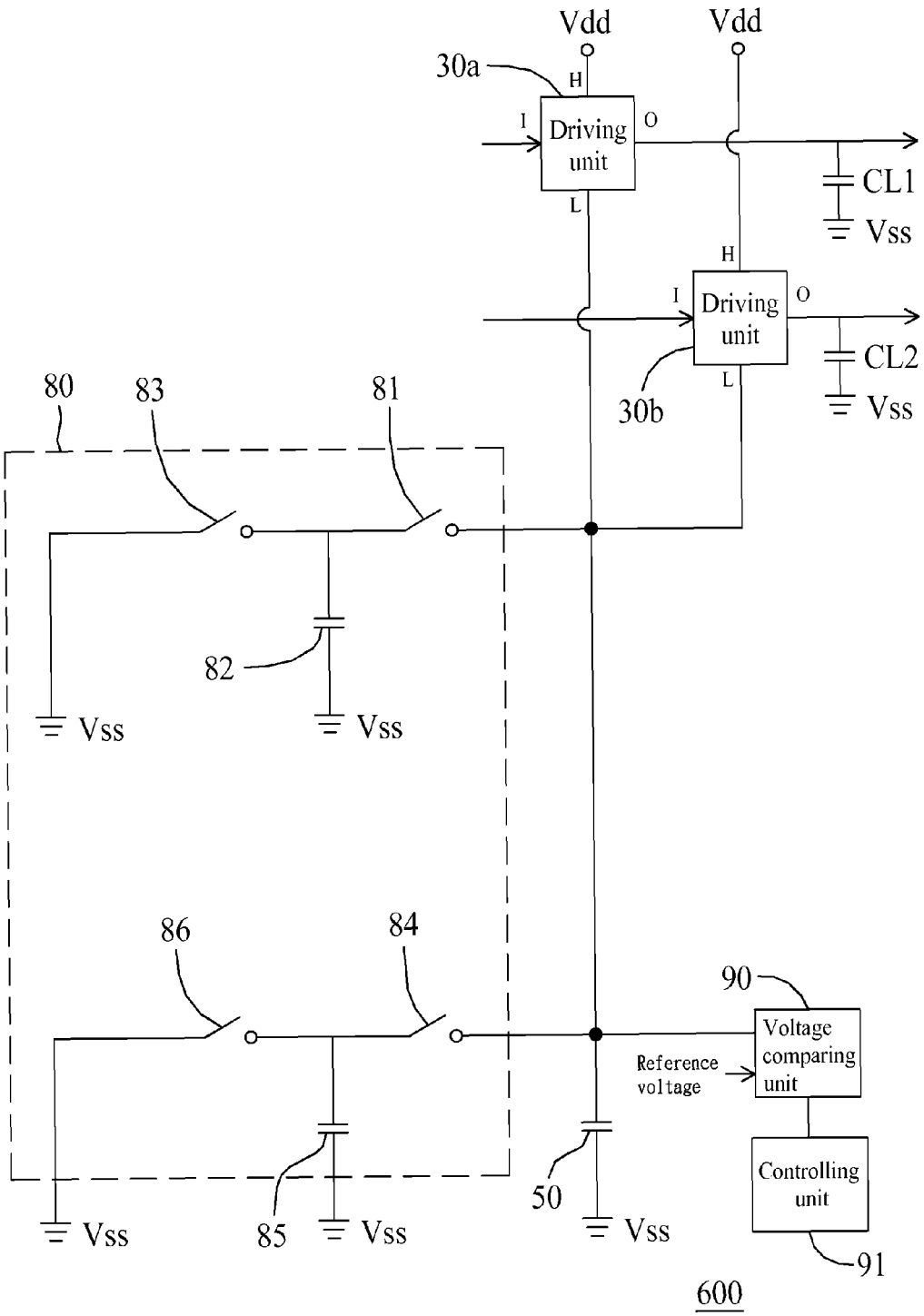
FIG. 6 shows a circuit diagram of a voltage generating circuit in accordance with another embodiment of the present invention.

FIG. 6 shows a circuit diagram of a voltage generating circuit 600 in accordance with an embodiment of the present invention. Referring to FIG. 6, the voltage generating circuit 500 may alternatively include the voltage comparing unit 90 and the controlling unit 91 that may perform the same operation as those of the voltage generating circuit 200 and may be referred thereto. The similar description is omitted.

Figure 7:
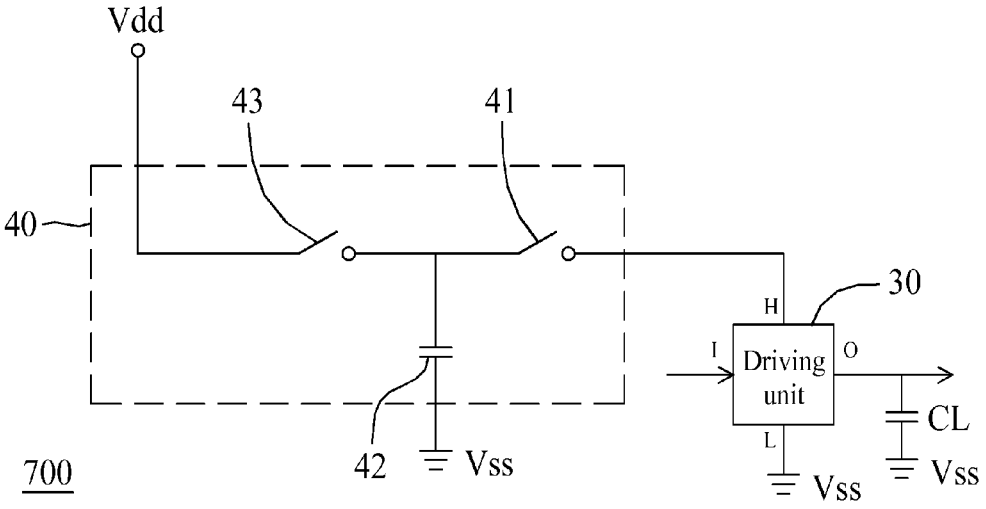
FIG. 7 shows a circuit diagram of a voltage generating circuit in accordance with another embodiment of the present invention.

FIG. 7 shows a circuit diagram of a voltage generating circuit 700 in accordance with an embodiment of the present invention. Referring to FIG. 7, the voltage generating circuit 700 includes a first driving unit 30, a first switch 41, a first compensating capacitor 42 and a second switch 43. The first driving unit 30 has a first input terminal I and a first output terminal O, wherein the first input terminal I is configured to receive a first input signal. When the first input signal is at a first logic level, such as logic level of 0, the first output terminal O is switched to couple a second voltage terminal H. When the first input signal is at a second logic level, such as logic level of 1, the first output terminal O is switched to couple a first voltage terminal L, such as Vss. The first driving unit 30 may include an inverter, buffer or pre-stage driver. The first switch 41 is configured to be switched to couple the second voltage terminal H to a first capacitance-compensating terminal based on the first input signal. The first compensating capacitor 42 is configured to be coupled between the first capacitance-compensating terminal and a third voltage terminal, such as Vss terminal or ground. The second switch 43 is configured to be switched to couple the first capacitance-compensating terminal to a fourth voltage terminal, such as Vdd terminal, based on the first input signal. Alternatively, the third voltage terminal may be a Vdd terminal, to which the present invention is not limited.

The paragraph takes an example of an inverter as the first driving unit 30 and positive metal-oxide-silicon (PMOS) devices as the first and second switches 41 and 43. When the first input signal is at a logic level of 1, the second switch 43 may be switched on to couple the first capacitance-compensating terminal to the fourth voltage terminal, such as Vdd terminal, that is, power maybe charged from the fourth voltage terminal to the first capacitance-compensating terminal of the first compensating capacitor 42, the first switch 41 may be switched off not to couple the second voltage terminal H to the first capacitance-compensating terminal, and the first output terminal O may be switched to couple the first voltage terminal L, such as Vss terminal or ground so as to output Vss or a logic level of 0. When the first input signal is at a logic level of 0, the second switch 43 may be switched off and the first switch 41 may be switched on such that the second voltage terminal H is coupled to the first capacitance-compensating terminal and electric charges, having been previously stored at the first capacitance-compensating terminal of the first compensating capacitor 42 when the first input signal is at a logic level of 1, may be charged to the first output terminal O through the second voltage terminal H; in other words, first electric charges, having been previously stored at the first capacitance-compensating terminal of the first compensating capacitor 42 when the first input signal is at a logic level of 1, may have a second electric charge to be shared to the first output terminal so as to generate at the second voltage terminal H a second voltage as an output voltage at the first output terminal O. In this case, the output voltage may have substantially the same value as the second voltage. This scenario may be called a charge-sharing concept. If the first output terminal has a first output capacitance CL and the fourth voltage terminal is powered at a fourth voltage, such as Vdd, the second voltage may be generated based on the fourth voltage and a ratio of a capacitance of the first compensating capacitor 42 to the first output capacitance CL. For example, if Vdd equals 1.8 V and the first output capacitance CL equals the capacitance of the first compensating capacitor 42, the second voltage equals 0.9 V; if Vdd equals 1.8 V and the first output capacitance CL equals a half of the capacitance of the first compensating capacitor 42, the second voltage equals 1.2 V; Thereby, the capacitance of the first compensating capacitor 42 may be adjusted to control the second voltage of the second voltage terminal H. The first output capacitance CL may be a capacitance seen from the first output terminal O, such as loading capacitance, parasitic capacitance or input capacitance of next-stage circuits.

Accordingly, when the first input signal is at a logic level of 1, a logic level of 0 represented by a voltage level of Vss at the first voltage terminal may be output from the first output terminal O. When the first input signal is at a logic level of 0, a logic level of 1 represented by the second voltage at the second voltage terminal may be output at the first output terminal O. The second voltage may be generated based on the fourth voltage and a ratio of a capacitance of the first compensating capacitor 42 to the first output capacitance CL. Thereafter, when the first input signal is at a logic level of 1 again, electric charges having been previously stored at the first output terminal O may be discharged to the first voltage terminal L. The first input signal may be a serial data stream at a high speed, such as at a speed higher than 1 GHz. Provided that the first input signal has the number of data periods at the first logic level substantially equal to the number of data periods of the first input signal at the second logic level within a predetermined time interval, the first switch 41 has turning-on time substantially equal to turning-on time of the second switch 43 within the predetermined time interval and thereby the second voltage may be kept at a stable level within the predetermined time interval. Besides, the voltage generating circuit 700 may be illustrated in another way. The voltage generating circuit 700 powered by Vdd and Vss includes the first driving unit 30 and a compensating unit 40. The first driving unit 30 has the first input terminal I and the first output terminal O, wherein the first input terminal I is configured to receive the first input signal. When the first input signal is at a first logic level, such as logic level of 1, a first level signal, such as Vss, is output at the first output terminal O. When the first input signal is at a second logic level, such as logic level of 0, a second level signal, such as the above-mentioned second voltage, is output at the first output terminal O. The compensating unit 40 includes the first switch 41, the first compensating capacitor 42 and the second switch 43 and generates the second voltage as the voltage level of the second level signal based on Vdd and the first input signal. The related operation may be referred to the above paragraphs and is omitted herein.

Figure 8:
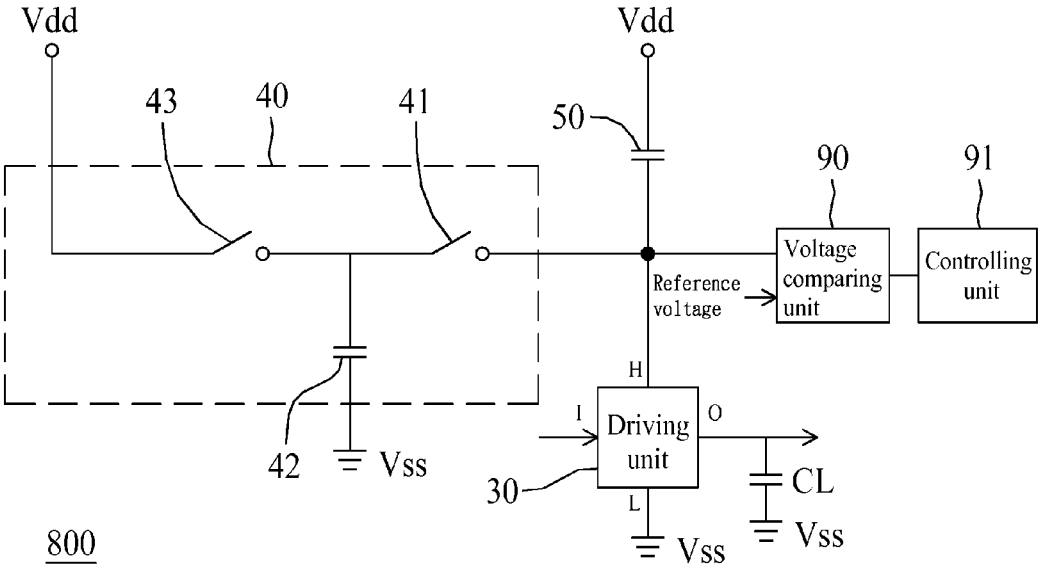
FIG. 8 shows a circuit diagram of a voltage generating circuit in accordance with another embodiment of the present invention.

FIG. 8 shows a circuit diagram of a voltage generating circuit 800 in accordance with another embodiment of the present invention. Referring to FIG. 8, the voltage generating circuit 700 may alternatively include a voltage comparing unit 90 and a controlling unit 91. Furthermore, please refer to FIGS. 3 and 4 showing switching capacitor arrays 70*a* and 70*b* for the first compensating capacitor 42, which is adjustable, in accordance with an embodiment of the present invention. The voltage comparing unit 90 is configured to compare the second voltage at the second voltage terminal H and a reference voltage so as to generate a comparison result. The controlling unit 91 is configured to control the capacitance-compensating switches 72 based on the comparison result so as to adjust the capacitance of the first compensating capacitor 42 and thus to adjust the voltage at the second voltage terminal H. The operation of the voltage generating circuit 800 may be referred to the voltage generating circuit 700 as above mentioned and the illustration for the related embodiments, such as the voltage generating circuit 200, and is not described herein. Alternatively, the second voltage terminal H may couple a voltage regulating capacitor 50 to stabilize the second voltage or reduce noise.

Figure 9:
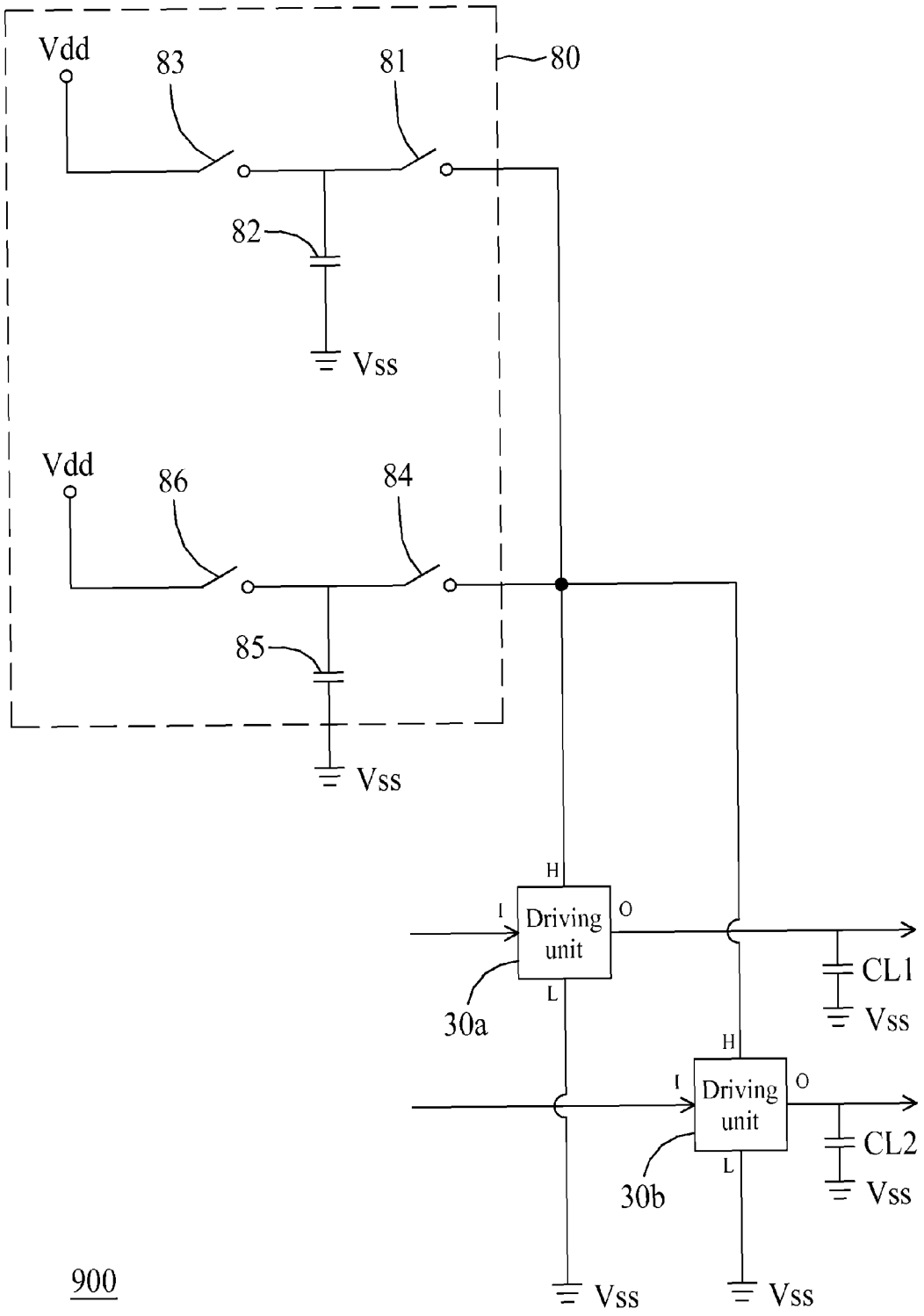
FIG. 9 shows a circuit diagram of a voltage generating circuit in accordance with another embodiment of the present invention.
Figure 10:
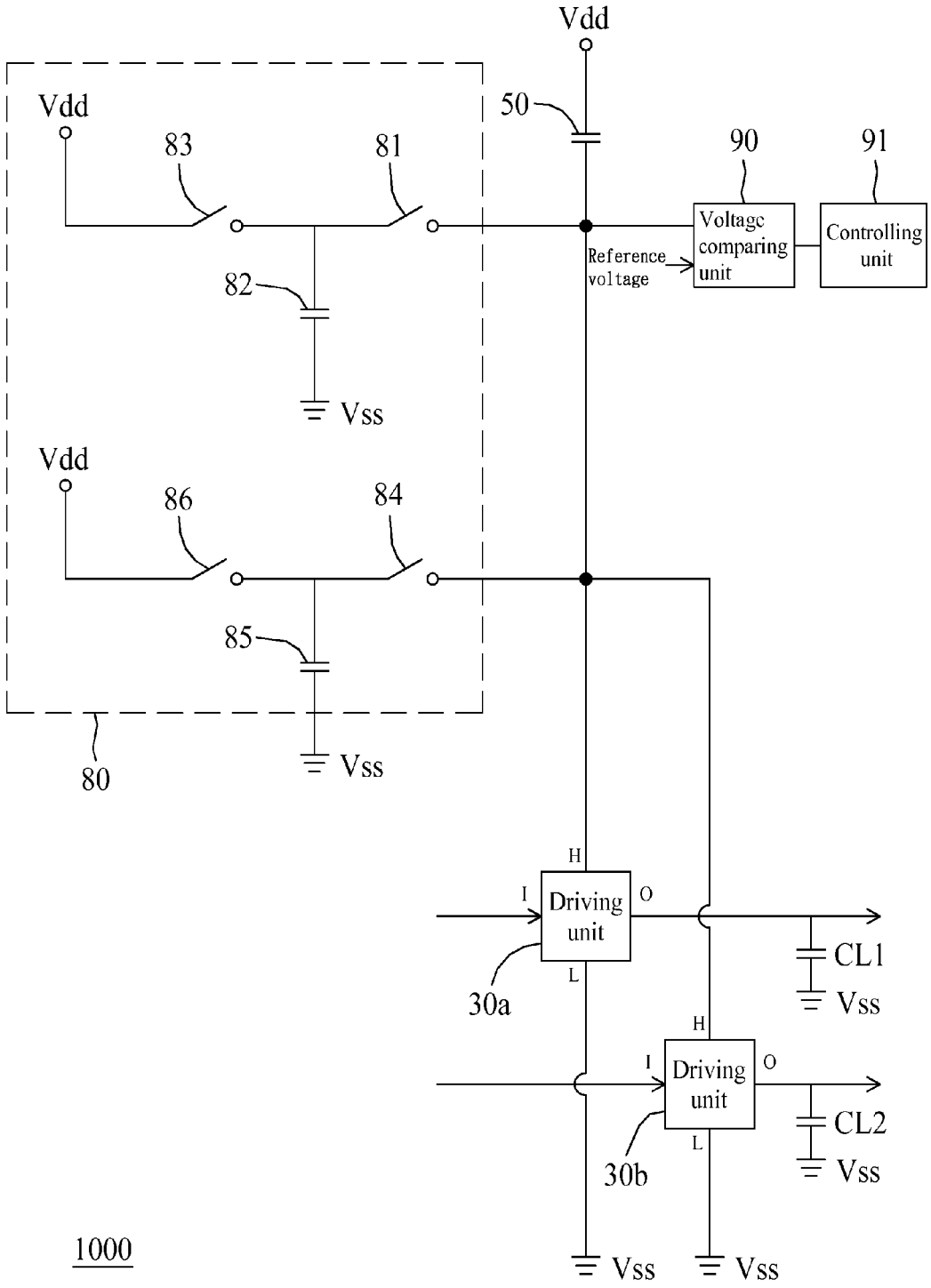
FIG. 10 shows a circuit diagram of a voltage generating circuit in accordance with another embodiment of the present invention.

FIG. 9 shows a circuit diagram of a voltage generating circuit 900, which is applied to a differential circuit, in accordance with another embodiment of the present invention. Referring to FIG. 7, the voltage generating circuit 900 may be composed of the two sets of voltage generating circuits 700 with the second voltage terminals coupled to each other. One of the two sets of voltage generating circuits 700 has the first input signal as an input of a driving unit 30*a;* the other one of the two sets of voltage generating circuits 700 has an inverse of the first input signal as an input of a driving unit 30*b;* that is, the voltage generating circuit 900 receives a pair of differential signals. A first switch 81 and third switch 84 correspond to the first switch 41; a first compensating capacitor 82 and second compensating capacitor 85 correspond to the first compensating capacitor 42; a second switch 83 and fourth switch 86 correspond to the second switch 43; a first output capacitance CL1 and second output capacitance CL2 correspond to the first output capacitance CL; compensating units 80 correspond to the two sets of compensating units 40. The operation of the voltage generating circuit 900 may be referred to the operation of the voltage generating circuit 700 as above mentioned. The similar description is omitted. It is noted that the first and third switches 81 and 83 are not switched on at the same time and the second and fourth switches 83 and 86 are not switched on at the same time. The second voltage may be generated based on the fourth voltage Vdd, a ratio of a capacitance of the first compensating capacitor 82 to the first output capacitance CL1 and a ratio of a capacitance of the second compensating capacitor 85 to the second output capacitance CL2. A voltage generating circuit 1000 in FIG. 10 is the voltage generating circuit 900 optionally incorporated with the voltage comparing unit 90 and controlling unit 91, the operation of which may be referred to the above illustration for the related embodiment. The similar description is omitted.

As mentioned above, in accordance with the present invention, a voltage less than a voltage level of Vdd, representing a logic level of 1, and greater than a voltage level of Vss or ground, representing a logic level of 0, may be generated using a voltage level of Vdd. This may be applied to a serial data stream at a high speed without any stability issue.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A voltage generating circuit comprising:

a first driving unit having a first input terminal and a first output terminal, wherein the first input terminal is configured to receive a first input signal, and wherein when the first input signal is at a first logic level, power is configured to be charged from a first voltage terminal to the first output terminal, and when the first input signal is at a second logic level, power is configured to be charged from the first output terminal to a second voltage terminal;

a first switch configured to couple the second voltage terminal to a first capacitance-compensating terminal based on the first input signal;

a first compensating capacitor configured to be coupled between the first capacitance-compensating terminal and a third voltage terminal; and a second switch configured to couple the first capacitance-compensating terminal to a fourth voltage terminal based on the first input signal.

2. The voltage generating circuit of claim 1, wherein the second voltage terminal has a second voltage configured to be adjusted by adjusting a capacitance of the first compensating capacitor.

3. The voltage generating circuit of claim 1, wherein when the first input signal is at the first logic level, a first electric charge is configured to pass from the first voltage terminal to the first output terminal, and when the first input signal is at the second logic level, a second electric charge is configured to pass from the first output terminal to the first compensating capacitor so as to generate at the second voltage terminal a second voltage as an output voltage at the first output terminal.

4. The voltage generating circuit of claim 3, wherein when the first input signal has the number of data periods at the first logic level substantially equal to the number of data periods of the first input signal at the second logic level within a time interval, the first switch has turning-on time substantially equal to turning-on time of the second switch within the time interval and the second voltage is kept at a stable level within the time interval.

5. The voltage generating circuit of claim 1, wherein the first compensating capacitor comprises a plurality of capacitance-compensating units coupling in parallel, each of the capacitance-compensating units comprises a capacitance-compensating switch and a second compensating capacitor coupling in series to the capacitance-compensating switch, and the voltage generating circuit further comprising:

a voltage comparing unit configured to compare a voltage at the second voltage terminal and a reference voltage so as to generate a comparison result; and a controlling unit configured to control the capacitance-compensating switches based on the comparison result so as to adjust a capacitance of the first compensating capacitor and a voltage of the second voltage terminal.

6. The voltage generating circuit of claim 3, wherein the first output terminal has a first output capacitance, the first voltage terminal is powered by a first voltage, and the second voltage is generated based on the first voltage and a ratio of a capacitance of the first compensating capacitor to the first output capacitance.

7. The voltage generating circuit of claim 1 further comprising:

a second driving unit comprising a second input terminal and a second output terminal, wherein the second input terminal is configured to receive a second input signal inverse to the first input signal, and wherein when the second input signal is at the first logic level, power is configured to be charged from a first voltage terminal to the second output terminal, and when the second input signal is at the second logic level, power is configured to be charged from the second output terminal to a second voltage terminal;

a third switch configured to couple the second voltage terminal to a second capacitance-compensating terminal based on the second input signal;

a second compensating capacitor configured to be coupled between the second capacitance-compensating terminal and the third voltage terminal; and a fourth switch configured to couple the second capacitance-compensating terminal to the fourth voltage terminal based on the second input signal.

8. A voltage generating circuit comprising:

a driving unit having a first input terminal and a first output terminal, wherein the first input terminal is configured to receive a first input signal, and wherein when the first input signal is at a first logic level, a first voltage terminal couples to the first output terminal, and when the first input signal is at a second logic level, the first output terminal couples to a second voltage terminal;

a first switch configured to couple the second voltage terminal to a first capacitance-compensating terminal based on the first input signal;

a first compensating capacitor configured to be coupled between the first capacitance-compensating terminal and a third voltage terminal; and a second switch configured to couple the first capacitance-compensating terminal to a fourth voltage terminal based on the first input signal.

9. The voltage generating circuit of claim 8, wherein when the first input signal is at the first logic level, a first electric charge is configured to pass from the fourth voltage terminal to the first compensating capacitor, and when the input signal is at the second logic level, a second electric charge is configured to be shared from the first electric charge in the first compensating capacitor to the first output terminal so as to generate at the second voltage terminal a second voltage as an output voltage at the first output terminal.

10. The voltage generating circuit of claim 9, wherein the first output terminal has a first output capacitance, the fourth voltage terminal is powered by a fourth voltage, and the second voltage is generated based on the fourth voltage and a ratio of a capacitance of the first compensating capacitor to the first output capacitance.

11. The voltage generating circuit of claim 8, wherein the first compensating capacitor comprises a plurality of capacitance-compensating units coupling in parallel, each of the capacitance-compensating units comprises a capacitance-compensating switch and a second compensating capacitor coupling in series to the capacitance-compensating switch, and the voltage generating circuit further comprising:

a voltage comparing unit configured to compare a voltage at the second voltage terminal and a reference voltage so as to generate a comparison result; and a controlling unit configured to control the capacitance-compensating switches based on the comparison result so as to adjust a capacitance of the first compensating capacitor.

12. A voltage generating circuit configured to be powered by a fifth voltage and a sixth voltage, comprising:

a first driving unit having a first input terminal and a first output terminal, wherein the first input terminal is configured to receive a first input signal, and wherein the first driving unit is configured to output a first level signal when the first input signal is at a first logic level and to output a second level signal when the first input signal is at a second logic level; and a compensating unit, comprising at least a switch and a capacitor and configured to generate a second voltage as the voltage level of the second level signal according to the fifth voltage and the first input signal;

wherein the second voltage is less than the fifth voltage and greater than the sixth voltage, and the voltage level of the first level signal is substantially equal to the fifth voltage or the sixth voltage.

13. The voltage generating circuit of claim 12, wherein the first output terminal has a first output capacitance, and the second voltage is generated based on the fifth voltage and a ratio of a capacitance of the capacitor to the first output capacitance.

* * * * *